US009647350B2

(12) United States Patent
Rushing

(10) Patent No.: US 9,647,350 B2
(45) Date of Patent: May 9, 2017

(54) GROUND CLAMP ADAPTER

(71) Applicant: GREAVES CORPORATION, Clinton, CT (US)

(72) Inventor: TC Rushing, Peoria, AZ (US)

(73) Assignee: Greaves Corporation, Clinton, CT (US)

( * ) Notice: Subject to any disclaimer, the term of this patent is extended or adjusted under 35 U.S.C. 154(b) by 0 days.

(21) Appl. No.: 14/957,931

(22) Filed: Dec. 3, 2015

(65) Prior Publication Data

US 2016/0164228 A1 Jun. 9, 2016

Related U.S. Application Data

(60) Provisional application No. 62/087,831, filed on Dec. 5, 2014.

(51) Int. Cl.

| | |
|---|---|
| ***H01R 4/66*** | (2006.01) |
| ***H01R 4/46*** | (2006.01) |
| ***H01R 4/64*** | (2006.01) |
| *H01R 4/60* | (2006.01) |

(52) U.S. Cl.
CPC ..... *H01R 4/46* (2013.01); *H01R 4/643* (2013.01); *H01R 4/646* (2013.01); *H01R 4/60* (2013.01); *H01R 4/66* (2013.01)

(58) Field of Classification Search
USPC ..... 439/100
See application file for complete search history.

(56) References Cited

U.S. PATENT DOCUMENTS

| | | | | |
|---|---|---|---|---|
| 2,122,547 A | | 7/1938 | Borden | |
| 3,798,585 A | * | 3/1974 | Thompson | H01R 4/643 439/806 |
| 4,976,627 A | * | 12/1990 | O'Loughlin | H02G 3/285 174/71 R |
| 5,306,170 A | | 4/1994 | Luu | |
| 5,480,311 A | | 1/1996 | Luu | |
| 5,752,860 A | * | 5/1998 | Greaves | H01R 4/44 439/100 |
| 7,703,722 B2 | * | 4/2010 | Bucciferro | F16B 2/065 248/229.23 |
| 7,708,234 B2 | * | 5/2010 | Kossak | F16B 2/065 248/229.23 |
| 7,780,461 B1 | | 8/2010 | Vernica | |

(Continued)

FOREIGN PATENT DOCUMENTS

DE EP1398850 A1 * 3/2004 ..... H01R 4/66

*Primary Examiner* — Tho D Ta
(74) *Attorney, Agent, or Firm* — Bachman & LaPointe, P.C.

(57) ABSTRACT

A ground clamp adapter for grounding electrical wire. The ground clamp adapter comprises a first section. The first section comprises a body having a platform extending laterally from the body. The platform having a lateral recess and a transverse recess orthogonally integrally formed in the platform. At least one bracket is adjustably coupled to the platform proximate one of the lateral recess and the transverse recess. The bracket and one of the lateral recess and the transverse recess are configured to clamp a grounding wire. A second section has a coupling portion configured to adjustably couple with the first section. The second section is configured to clamp onto a pipe shaped object to conduct electricity to ground.

6 Claims, 4 Drawing Sheets

(56) References Cited

U.S. PATENT DOCUMENTS

| | | | | |
|---|---|---|---|---|
| 8,177,563 | B1 | 5/2012 | Vernica | |
| 8,313,334 | B2 * | 11/2012 | Ruland | H01R 4/38 439/100 |
| 8,317,526 | B2 | 11/2012 | Gardner et al. | |

* cited by examiner

GROUND CLAMP ADAPTER

This application claims the benefit of U.S. Provisional Application No. 62/087,831 that was filed Dec. 5, 2014, by TC Rushing, which was entitled "Ground Clamp Adapter," and which is also incorporated herein by reference.

BACKGROUND

The present disclosure is directed to clamps configured to connect wires, conduits, rods, and the like to electrically ground the wires coupled thereto.

FIGS. 1-3 show an illustration of a prior art ground clamp 10. The ground clamp 10 includes a first section 12 and a second section 14. The first section 12 is configured to clamp onto wire 16, preferably grounding wire 16 that is designed to electrically ground electrical circuits (not shown). The first section 12 and second section 14 are constructed of electrically conductive material, configured to conduct electrical current so that an electrical circuit can be grounded.

The first section 12 includes a retainer 18. The retainer 18 is configured to secure the wire 16. The first section 12 can include a body portion 20 having a platform 22 extending laterally from the body portion 20. Two wire clamp brackets 24 aligned in only one direction are coupled to the first section 12 at the platform 22. Threaded fasteners 26 can be used, allowing the brackets 24 to be removable and adjustable. The wire clamp brackets 24 cover the wire 16 and are tightened to compress the wire 16 in a secured fashion. The brackets 24 are shaped to snugly fit over the circular cross-section of wire. Typically, a U-shape or a V-shape. The first section 12 is coupled to the second section 14 via a threaded fastener, screw 26. The body 20 of the first section has a top portion 28 and bottom portion 30. The top portion 28 receives the screw 26 inserted through a passage 32 that extends the length of the body 20. The first section 12 body 20 includes a cavity 34 (not visible) having a cylindrical shape and configured to nest with the second section 14.

The second section 14 includes coupling portion 36 shaped as a cylinder and configured to insert into the cavity 34 of the first section 12. The second section 14 includes a crown of ridges 38 having peaks and valleys configured to interlock with a mating set of ridges 40 formed on the bottom portion 30 of the first section 12. The ridges 38, 40 interlock and nest together to from a firm and fixed adjustable coupling 42 that is tightened in a secure fashion by the screw 26. The adjustable coupling 42 allows for the first section 12 and the second section 14 to couple together, swivel and be adjusted in a rotary fashion relative to each other. The adjustable coupling 42 permits multiple positions between the first section 12 and the second section 14.

The second section 14 includes a first clamping portion 44 proximate the coupling portion 36 and a second clamping portion 46 separable from the first clamping portion 44. The first and second clamping portions 44, 46 are configured as v-shaped or U-shaped members that join together to clamp over the circular cross section of a rod or pipe, or conduit 48. The first and second clamping portions 44, 46 are adjustable and coupled together via threaded fasteners 26. The threaded fasteners 26 allow for adjustment of the clamping portions 44, 46 to fit over a variety of diameters. The adjustable feature also allows for the ground clamp 10 to be positioned to fit into a particular location. The clamping portions 44, 46 can include ridges or other surface features 50 that enhance the friction between the clamp 10 and the pipe 48 as well as the electrical connectivity between the clamp 10 and pipe 48 to conduct electricity for the grounding function.

The drawback of the previous ground clamp 10 described above is the limited capability to connect to the wire 16. The wire 16 can only be connected at a single end, that is dead-ended, with the first section 12 at the retainer 18.

What is needed is a ground clamp that allows for multiple wire connections without cumbersome complex reconstruction of the ground clamp.

SUMMARY

In accordance with the present disclosure, there is provided a ground clamp adapter comprising a first section. The first section comprises a body with a platform extending laterally from the body. The platform has a lateral recess and a transverse recess orthogonally integrally formed in the platform. The lateral recess and the transverse recess are configured to receive a wire. At least one bracket is adjustably coupled to the platform proximate one of the lateral recess and the transverse recess. The at least one bracket is configured to secure the wire in one of the lateral recess and the transverse recess. A second section has a coupling portion configured to adjustably couple with the first section. The second section is configured to clamp onto a pipe shaped object.

In another and alternative embodiment, the lateral recess and the at least one bracket form a lateral retainer configured to secure the wire for electrical grounding.

In another and alternative embodiment, the transverse recess and the at least one bracket form a transverse retainer configured to secure the wire for electrical grounding.

In another and alternative embodiment, the first section and the second section are configured to conduct electricity to ground an electrical circuit.

In another and alternative embodiment, the lateral retainer is configured to securely clamp a wire in a terminated manner.

In another and alternative embodiment, the transverse retainer is configured to securely clamp a wire in a continuous manner.

Other details of the ground clamp adapter are set forth in the following detailed description and the accompanying drawing wherein like reference numerals depict like elements.

DETAILED DESCRIPTION

Figure 1:
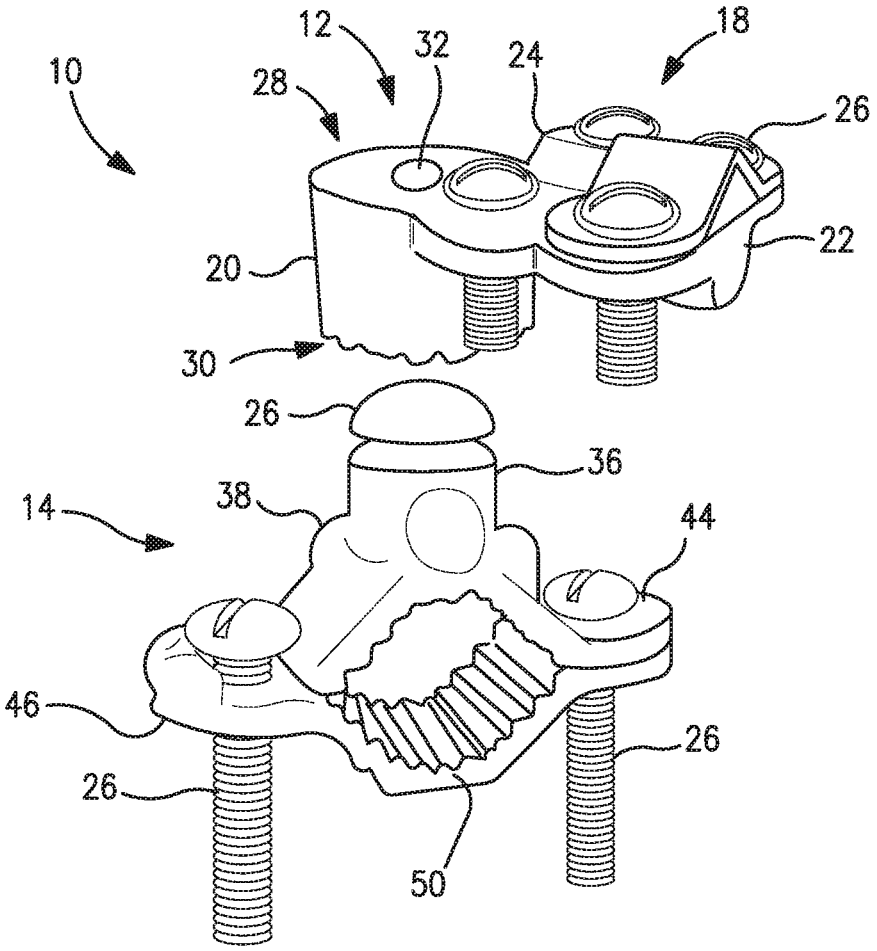
FIG. 1 PRIOR ART
FIG. 1 is an illustration of a prior art electrical ground clamp with the first section and the second section disassembled.
Figure 2:
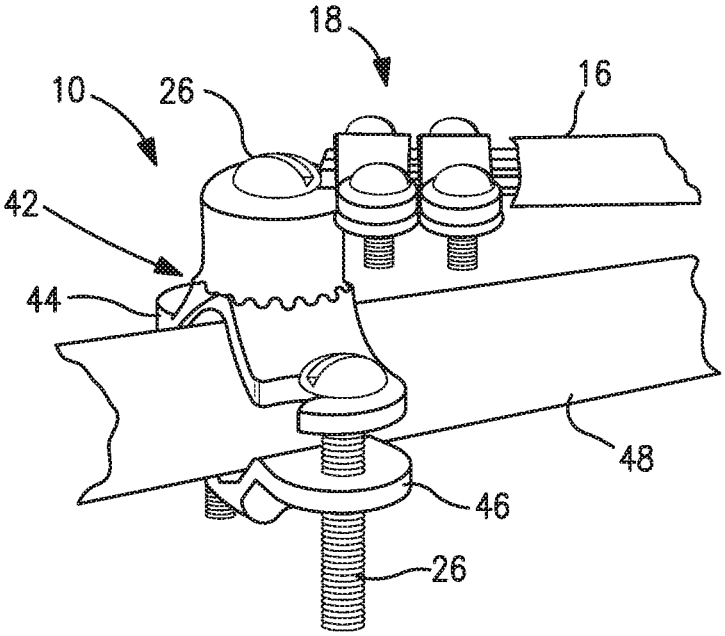
FIG. 2 PRIOR ART
FIG. 2 is an illustration of a prior art electrical ground clamp coupled to a pipe and a wire.
Figure 3:
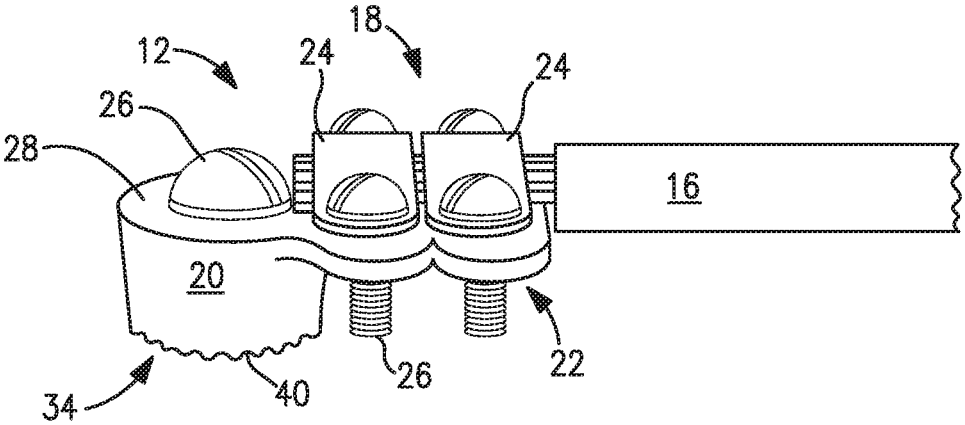
FIG. 3 PRIOR ART
FIG. 3 is a schematic of a prior art electrical ground clamp first section coupled to a wire.
Figure 4:
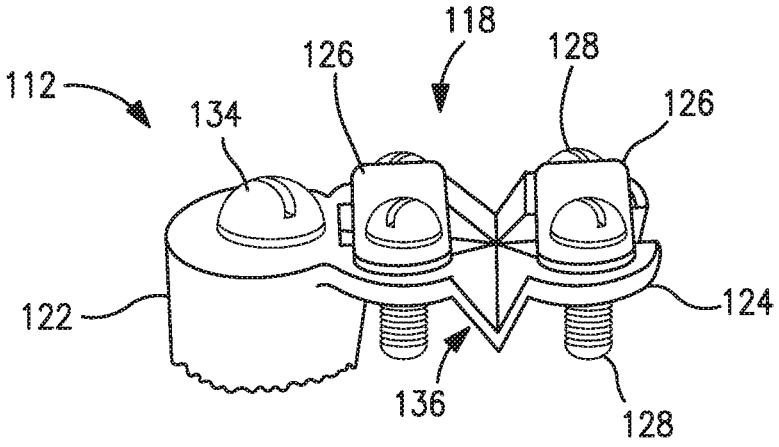
FIG. 4 is an illustration of an improved electrical ground clamp first section.
Figure 5:
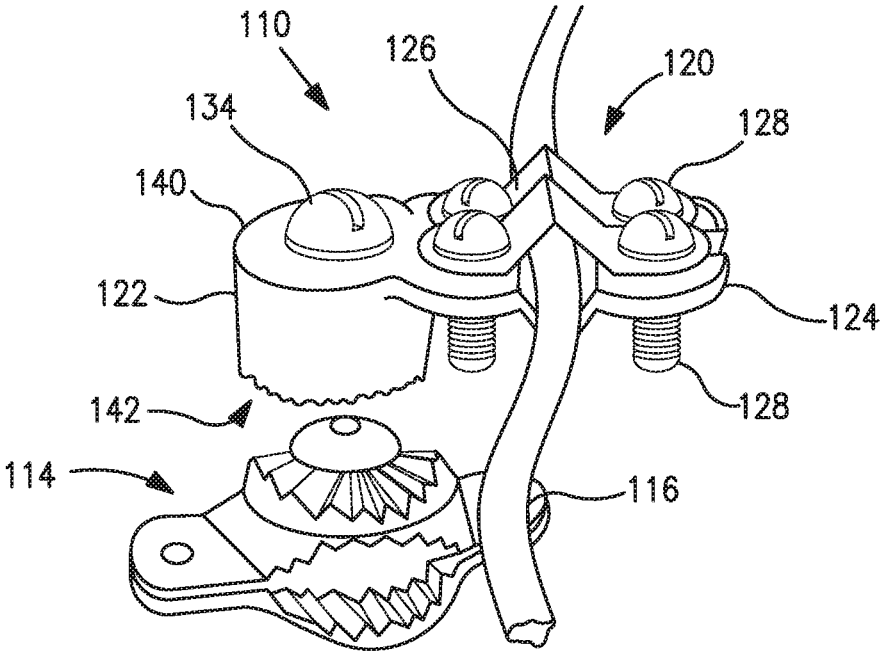
FIG. 5 is an illustration of the electrical ground clamp with the first section clamped to a wire in a continuous manner and the second section disassembled.
Figure 6:
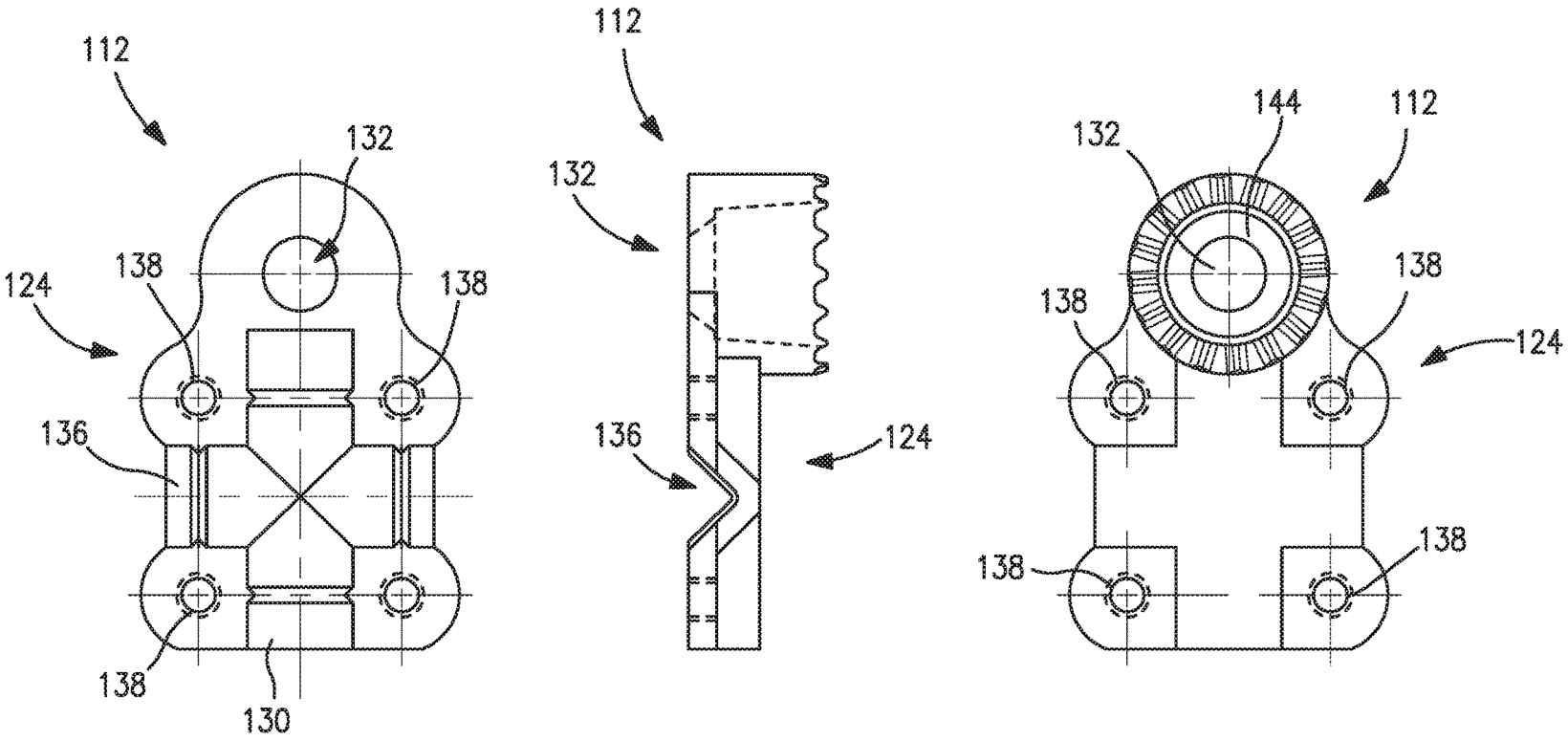
FIG. 6 is a mechanical drawing with three views of the improved electrical ground clamp first section.

Referring now to FIGS. 4-6, there is illustrated an improved ground clamp 110 first section 112. The ground clamp 110 includes the first section 112 and similar to the above described clamp 10 a second section 114. The second section 114 of clamp 110 is similar to the above described second section 14.

The first section 112 is configured to clamp onto wire 116, preferably grounding wire 116 that is designed to electrically ground electrical circuits (not shown). The first section 112 and second section 114 are constructed of electrically conductive material, so that an electrical circuit can be grounded.

The first section 112 includes a lateral retainer 118 at FIG. 4, and a transverse retainer 120, at FIG. 5. The first section 112 includes a body portion 122 having a platform 124 extending laterally from the body portion 122. One or more straps or wire clamp brackets 126 are coupled to the first section 112 at the platform 124. In a preferred embodiment, two brackets 126 are utilized. Threaded fasteners 128 can be used, allowing the brackets 126 to be removable and adjustable. The wire clamp brackets 126 cover the wire 116 and are tightened to compress the wire 116 in a secured fashion. The brackets 126 are shaped to fit over a variety of wire diameter sizes. The brackets 126 can have a U-shaped cross section or a V-shaped cross section as shown the FIGS. 4, 5.

The platform 124 of the improved ground clamp 110 has additional features that the previous design failed to contemplate. The platform 124 includes a lateral recess 130. The lateral recess 130 extends along the length of the platform 124 and terminates at the body 122 proximate to a central passage 132. The central passage 132 receives the screw 134 that secures the first section 112 to the second section 114. The lateral recess 130 is configured as a V-shaped or U-shaped recess that receives the wire 116. The lateral recess 130 cooperates with the wire clamp brackets 126 to enable the lateral retainer 118 to secure the wire 116. The wire 116 is retained and aligned in the lateral retainer 118 in a lateral fashion, that is, parallel to the platform 124. The wire 116 is retained in the first section 112 lateral retainer 118 similarly to the above described embodiment of the retainer 18 of the ground clamp 10.

The first section 112 includes an additional retainer, the transverse retainer 120. The transverse retainer 120 is formed by the wire clamp brackets 126 and a transverse recess 136 formed in the platform 124 orthogonal to the lateral recess 130. The transverse recess 136 can have a similar cross-section as the lateral recess 130, that is, a V-shape or U-shape cross-section. The transverse recess 136 is configured to cooperate with the wire clamp brackets 126 to enable the transverse retainer 120 to secure the wire 116, as shown in FIG. 5. The transverse retainer 120 secures the wire 116 orthogonal to, i.e., transverse to the platform 124. The transverse retainer 120 also clamps the wire 116 in an orthogonal fashion, the wire 116 is extendable through the transverse retainer 120. The wire 116 does not have to be dead-ended, i.e., terminated, at the transverse retainer 120. The wire 116 can pass through the clamp 110 extending in both directions, in a continuous manner, away from the clamp 110.

The first retainer 118 is configured to secure the wire 116 similarly to the above described retainer 18, such that the wire 116 is inserted and clamped laterally, substantially parallel to the axis of the wire 116.

However, with the inventive addition of the transverse retainer, the ground clamp 110 can be adjusted easily, to clamp a continuous wire 116. Of course a wire 116 could also be terminated with the transverse retainer 120.

The wire clamp brackets 126 being detachable can be shifted to either align with the lateral recess 130 or the transverse recess 136 utilizing the same two pairs of threaded receivers 138.

The first section 112 is coupled to the second section 114 via the screw 134. The body 122 of the first section 114 has a top portion 140 and bottom portion 142. The top portion 140 receives the screw 134 inserted through a passage 132 that extends the length of the body 122. The first section 112 body 122 includes a cavity 144, (FIG. 6) having a cylindrical shape and configured to nest with the second section 114.

The ground clamp adaptor has the advantages of being configured to clamp a ground wire to a ground pipe in multiple orientations. The ground clamp adaptor is capable of clamping a ground wire in a terminated manner. The clamp can also be easily adjusted to clamp a wire so that the wire can pass through in a continuous manner. The first section and second section are capable of being adjusted in a rotary fashion, allowing for the first section to swivel relative to the second section. This feature allows the ground wire to be secured to the ground pipe in multiple orientations. The lateral retainer and transverse retainer can be configured to accept a wide variety of gauges and wire styles.

There has been provided a ground clamp adapter. While the ground clamp adapter has been described in the context of specific embodiments thereof, other unforeseen alternatives, modifications, and variations may become apparent to those skilled in the art having read the foregoing description. Accordingly, it is intended to embrace those alternatives, modifications, and variations which fall within the broad scope of the appended claims.

What is claimed is:

1. A ground clamp adapter comprising:

a first section, said first section comprising a body having a unitary platform extending laterally from said body, wherein said unitary platform is formed as one-piece;

said unitary platform having a lateral recess and a transverse recess orthogonally integrally formed in said unitary platform, said lateral recess and said transverse recess configured to receive a wire;

at least one removable bracket adjustably coupled to said unitary platform proximate one of said lateral recess and said transverse recess, said at least one removable bracket configured to secure said wire in one of said lateral recess and said transverse recess;

a second section, said second section having a coupling portion configured to adjustably couple with said first section, said second section configured to clamp onto a pipe shaped object.

2. The ground clamp of claim 1, wherein said lateral recess and said at least one bracket form a lateral retainer configured to secure said wire for electrical grounding.

3. The ground clamp of claim 1, wherein said transverse recess and said at least one bracket form a transverse retainer configured to secure said wire for electrical grounding.

4. The ground clamp of claim 1, wherein first section and said second section are configured to conduct electricity to ground.

5. The ground clamp of claim 2, wherein the lateral retainer is configured to securely clamp a wire in a terminated manner, that is, the specific point at which the wire ends or starts.

6. The ground clamp of claim 3, wherein said transverse retainer is configured to securely clamp a wire in a continuous manner.

* * * * *